US011401844B2

(12) United States Patent
Komaki et al.

(10) Patent No.: US 11,401,844 B2
(45) Date of Patent: Aug. 2, 2022

(54) BLOW-BY GAS LEAK DIAGNOSTIC DEVICE

(71) Applicant: NIDEC TOSOK CORPORATION, Kanagawa (JP)

(72) Inventors: Chikao Komaki, Kanagawa (JP); Ryota Ito, Kanagawa (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 0 days.

(21) Appl. No.: 17/560,258

(22) Filed: Dec. 23, 2021

(65) Prior Publication Data

US 2022/0205375 A1 Jun. 30, 2022

(30) Foreign Application Priority Data

Dec. 28, 2020 (JP) ..... JP2020-219565

(51) Int. Cl.

| | |
|---|---|
| ***F01M 11/10*** | (2006.01) |
| ***F02M 25/06*** | (2016.01) |
| ***F01M 13/02*** | (2006.01) |
| *F01M 13/00* | (2006.01) |

(52) U.S. Cl.

CPC ..... *F01M 11/10* (2013.01); *F01M 13/028* (2013.01); *F02M 25/06* (2013.01); *F01M 2013/0044* (2013.01); *F01M 2013/0083* (2013.01); *F01M 2250/60* (2013.01)

(58) Field of Classification Search

CPC ..... F01M 11/10; F01M 13/028; F01M 2013/0044; F01M 2013/0083; F01M 2250/60; F02M 25/06

See application file for complete search history.

(56) References Cited

U.S. PATENT DOCUMENTS

| | | | | |
|---|---|---|---|---|
| 10,760,516 | B2 | 9/2020 | Takahashi et al. | |
| 2008/0257320 | A1* | 10/2008 | Asanuma | F02M 25/06 123/573 |
| 2011/0197864 | A1* | 8/2011 | Karcher | F02M 25/06 123/574 |
| 2014/0137544 | A1* | 5/2014 | Pursifull | B60T 13/66 60/327 |
| 2016/0097354 | A1* | 4/2016 | Martus | F01M 11/00 123/572 |
| 2017/0002761 | A1* | 1/2017 | Dudar | F02D 41/22 |
| 2017/0328810 | A1* | 11/2017 | Yaeo | G01M 15/09 |
| 2018/0030937 | A1* | 2/2018 | Golladay | F01M 13/023 |
| 2018/0283976 | A1* | 10/2018 | Shiwa | G01M 3/007 |

(Continued)

*Primary Examiner* — Hung Q Nguyen

(74) *Attorney, Agent, or Firm* — Hauptman Ham, LLP

(57) ABSTRACT

A blow-by gas leak diagnostic device includes a first PCV flow path, a second PCV flow path, a fresh air inlet, a pressure measurement unit, a first valve that opens and closes the first PCV flow path, a second valve that opens and closes the second PCV flow path, a third valve that opens and closes the fresh air inlet, a valve control unit, and a leak diagnosis unit. The valve control unit controls an opening degree of the third valve when a downstream side of an intake manifold with respect to a throttle valve has a negative pressure, and the second valve is in a closed state. The leak diagnosis unit diagnoses presence or absence of a leak in the first PCV flow path on the basis of an inner pressure of the first PCV flow path measured by the pressure measurement unit.

3 Claims, 3 Drawing Sheets

(56) References Cited

U.S. PATENT DOCUMENTS

| | | | | |
|---|---|---|---|---|
| 2018/0371971 | A1* | 12/2018 | Nakano | F02M 35/10222 |
| 2019/0226368 | A1* | 7/2019 | Hofmann | F02M 35/10222 |
| 2019/0285018 | A1* | 9/2019 | Dudar | F02M 35/024 |
| 2020/0123944 | A1* | 4/2020 | Ishikawa | F02M 35/10209 |
| 2020/0256276 | A1* | 8/2020 | Sekiguchi | F02M 35/08 |
| 2020/0400051 | A1* | 12/2020 | Henson | F01M 13/0011 |

* cited by examiner

FIG. 2

| | ENGINE STATE | PRESSURE OF INTAKE MANIFOLD ON DOWNSTREAM SIDE OF THROTTLE VALVE | STATE OF FIRST VALVE | STATE OF SECOND VALVE | STATE OF THIRD VALVE |
|---|---|---|---|---|---|
| (A) | LOW LOAD | NEGATIVE PRESSURE | OPEN NORMAL FLOW AMOUNT BLOW-BY GAS DISCHARGE | CLOSE REVERSE FLOW AMOUNT | OPEN FRESH AIR |
| (B) | HIGH LOAD | POSITIVE PRESSURE | CLOSE REVERSE FLOW AMOUNT | OPEN NORMAL FLOW AMOUNT BLOW-BY GAS DISCHARGE | CLOSE FLOW AMOUNT BLOCKAGE |
| (C) | LEAK DIAGNOSI | NEGATIVE PRESSURE | OPEN NORMAL FLOW AMOUNT BLOW-BY GAS DISCHARGE | CLOSE REVERSE FLOW AMOUNT | OPEN FRESH AIR ↔ CLOSE FLOW AMOUNT BLOCKAGE |

BLOW-BY GAS LEAK DIAGNOSTIC DEVICE

CROSS-REFERENCE TO RELATED APPLICATIONS

The present invention claims priority under 35 U.S.C. § 119 to Japanese Patent Application No. 2020-219565 filed on Dec. 28, 2020, the entire content of which is incorporated herein by reference.

FIELD OF THE INVENTION

The present disclosure relates to a blow-by gas leak diagnostic device.

BACKGROUND

In order to discharge a blow-by gas leaked into a crankcase from a combustion chamber through a gap between a cylinder and a piston, an engine is provided with a blow-by gas treatment device for returning the blow-by gas in the crankcase to an intake manifold (intake channel).

A general blow-by gas treatment device includes a fresh air inlet which allows the upstream side of the intake manifold with respect to a throttle valve to communicate with the crankcase, and a blow-by gas channel which allows the downstream side of the intake manifold with respect to the throttle valve to communicate with the crankcase. A leak detection valve for controlling opening and closing of a flow path is provided in the fresh air inlet, and a check valve capable of adjusting an opening degree is provided in the blow-by gas channel.

According to the blow-by gas treatment device, a fresh air is introduced into the crankcase through the fresh air inlet under normal operating conditions except for a high load region, so as to ventilate the inside of the crankcase. Further, when a negative pressure is generated in the intake manifold, the check valve of the blow-by gas channel becomes in an open state, and the blow-by gas in the crankcase flows into the intake manifold and returns to the inside of the engine.

Here, in the blow-by gas treatment device, a leak may occur in the blow-by gas flow path due to damage, deterioration, or the like of the blow-by gas flow path. In this case, the blow-by gas may be released from the blow-by gas flow path to the atmosphere, and thus it is necessary to detect whether or not a leak has occurred in the blow-by gas flow path. In this regard, conventionally, a leak detection device is known which measures the inner pressure of the crankcase after closing the leak detection valve of the fresh air inlet, and detects the leak of the blow-by gas flow path on the basis of this pressure when the engine is in a low load operation.

However, in the above-described conventional leak detection device or the like, when the engine is in a high load operation, the downstream side of the intake manifold with respect to the throttle valve has a positive pressure, and the check valve of the blow-by gas flow path becomes in a closed state. Accordingly, there is a risk that the blow-by gas in the crankcase returns to the engine through the fresh air inlet which communicates with the upstream side with respect to a supercharger, and at that time, remains as a deposit near the leak detection valve of the fresh air inlet. In this case, the leak detection valve may deteriorate, and the leak diagnosis of the blow-by gas flow path using the leak detection valve may not be performed accurately.

SUMMARY

One aspect of an exemplary blow-by gas leak diagnostic device of the present disclosure is a blow-by gas leak diagnostic device which includes a first positive crankcase ventilation (PCV) flow path that allows a crankcase of an engine to communicate with a downstream side of an intake manifold of the engine with respect to a throttle valve, a second PCV flow path that allows the crankcase of the engine to communicate with an upstream side of the intake manifold with respect to the throttle valve, and a fresh air inlet that allows the crankcase of the engine to communicate with the upstream side of the intake manifold with respect to the throttle valve, and diagnoses a leak in the first PCV flow path. The blow-by gas leak diagnostic device includes: a pressure measurement unit that measures an inner pressure of the first PCV flow path; a first valve that opens and closes the first PCV flow path; a second valve that opens and closes the second PCV flow path; a third valve that opens and closes the fresh air inlet; a valve control unit that controls an opening degree of the third valve; and a leak diagnosis unit that diagnoses the leak in the first PCV flow path. The valve control unit controls the opening degree of the third valve when the downstream side of the intake manifold with respect to the throttle valve has a negative pressure, and the second valve is in a closed state, and the leak diagnosis unit diagnoses presence or absence of the leak in the first PCV flow path on the basis of the pressure measured by the pressure measurement unit.

The above and other elements, features, steps, characteristics and advantages of the present disclosure will become more apparent from the following detailed description of the preferred embodiments with reference to the attached drawings.

BRIEF DESCRIPTION OF THE DRAWINGS

FIG. 2 is a table for explaining a relationship among a state of the engine, a state of a pressure of an intake manifold, a state of a first valve, and the like at the time of low load, high load, and leak diagnosis.

DETAILED DESCRIPTION

Hereinafter, preferred embodiments of the present disclosure will be described in detail with reference to the accompanying drawings.

Figure 1:
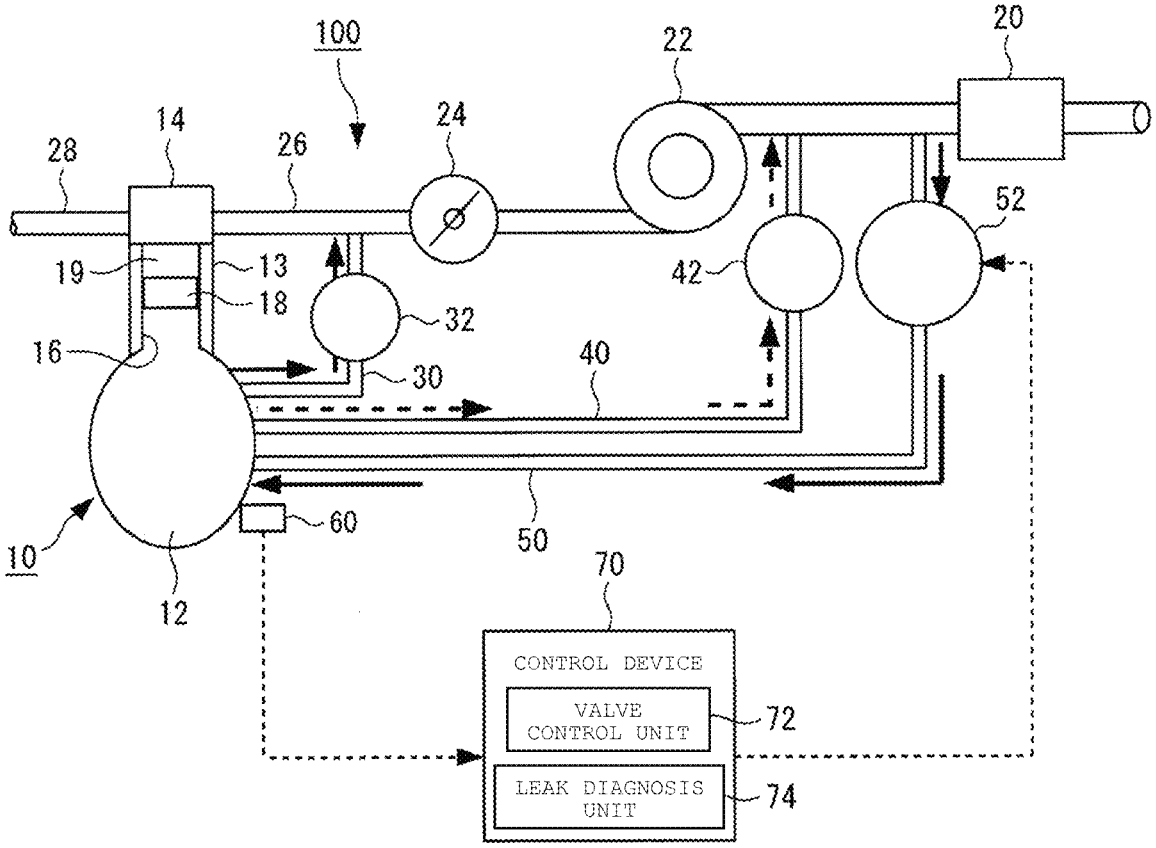
FIG. 1 is a schematic diagram of an engine including a blow-by gas leak diagnostic device according to an embodiment.

FIG. 1 is a schematic view of an engine 10 including a blow-by gas leak diagnostic device 100 according to this embodiment. Incidentally, in FIG. 1, the flow of a blow-by gas and a fresh air in an operation region where the engine 10 has a low load (natural intake) is indicated by a solid arrow, and the flow of a blow-by gas in an operation region where the engine 10 has a high load (supercharged) is indicated by a thick dashed arrow.

As illustrated in FIG. 1, the engine 10 which is an internal combustion engine includes a cylinder block 13, a cylinder head 14 provided in the upper portion of the cylinder block 13, and a crankcase 12 provided in the lower portion of the cylinder block 13. An oil pan (not illustrated) is provided in the lower portion the crankcase 12. A cylinder 16 is provided inside the cylinder block 13, and a piston 18 is provided to be able to reciprocate in the cylinder 16. The space surrounded by the cylinder block 13 and the piston 18 is a combustion chamber 19.

In the engine 10, during the combustion stroke of the engine 10, a small amount of unburned gas (partially including a burned gas) which is a so-called blow-by gas may leak into the crankcase 12 from the combustion chamber 19 through a gap around the piston 18 due to the increase in the inner pressure of the combustion chamber 19. The blow-by gas contains nitrogen oxides (NOx), which is harmful substances, and the like. Therefore, in this embodiment, the engine 10 is provided with a first PCV flow path 30, a first valve 32, and the like for discharging the blow-by gas in the crankcase 12. Incidentally, the first PCV flow path 30 and the like will be described later.

The downstream end portion of an intake manifold 26 communicates with the intake port formed in the cylinder head 14, and the upstream end portion of an exhaust manifold (exhaust passage) 28 communicates with the exhaust port formed in the cylinder head 14. The intake manifold 26 is provided with an air cleaner 20, a supercharger 22, and a throttle valve 24 in this order from the upstream side in an air flow direction.

The air cleaner 20 removes foreign matters, such as dirt and dust, contained in an intake air. The supercharger 22 is, for example, a turbocharger and is a compressor driven by an exhaust turbine (not illustrated) in the exhaust manifold 28. Incidentally, a mechanical supercharger driven by the output of the engine 10, an electric motor, or the like can also be used as the supercharger 22.

The opening degree of the throttle valve 24 is adjusted by an actuator such as an electric motor (not illustrated) to change the flow rate of the intake air supplied to the combustion chamber 19. Incidentally, although not illustrated, an intercooler for cooling the intake air which has become high temperature due to supercharging may be provided on the downstream side of the intake manifold 26 with respect to the supercharger 22.

The engine 10 is provided with the first PCV flow path 30 and the second PCV flow path 40 for discharging a blow-by gas from the inside of the crankcase 12 and a fresh air inlet 50 for introducing a fresh air into the crankcase 12.

One end portion of the first PCV flow path 30 communicates with the crankcase 12 of the engine 10, and the other end portion of the first PCV flow path 30 communicates with the connection portion of the intake manifold 26 on the downstream side with respect to the throttle valve 24.

The first PCV flow path 30 is provided with the first valve 32 which opens and closes the first PCV flow path 30 and allows only the flow of the blow-by gas from the inside of the crankcase 12 toward the intake manifold 26. The first valve 32 may be configured by, for example, a flow-rate control valve of which the opening degree is adjusted according to a negative pressure of the intake manifold 26 side, specifically, a pressure difference between the inside of the engine 10 and the front or rear of the intake manifold 26 side. Incidentally, although the first valve 32 is provided in the middle of the path of the first PCV flow path 30 in FIG. 1, for example, the first valve 32 may be provided at the connection portion with the crankcase 12 or may be provided at the connection portion with the intake manifold 26.

One end portion of the second PCV flow path 40 communicates with the crankcase 12 of the engine 10, and the other end portion of the second PCV flow path 40 communicates with the connection portion of the intake manifold 26 on the upstream side with respect to the throttle valve 24.

The second PCV flow path 40 is provided with a second valve 42 which opens and closes the second PCV flow path 40 and allows only the flow of the blow-by gas from the inside of the crankcase 12 toward the intake manifold 26. The second valve 42 can be configured by a flow-rate control valve of which the opening degree is adjusted according to the pressure difference between the inside of the engine 10 and the front or rear of the intake manifold 26 side. Incidentally, although the second valve 42 is provided in the middle of the path of the second PCV flow path 40 in FIG. 1, for example, the second valve 42 may be provided at the connection portion with the crankcase 12 or may be provided at the connection portion with the intake manifold 26.

One end portion of the fresh air inlet 50 communicates with the crankcase 12 of the engine 10, and the other end portion of the fresh air inlet 50 communicates with the connection portion of the intake manifold 26 on the upstream side with respect to the throttle valve 24.

The fresh air inlet 50 is provided with a third valve 52 which opens and closes the flow path of the fresh air inlet 50. The third valve 52 is configured by, for example, a solenoid valve, and can control the introduction of a fresh air from the intake manifold 26 into the crankcase 12 by adjusting the opening degree on the basis of the control of a valve control unit 72 described later. Incidentally, although the third valve 52 is provided in the middle of the path of the fresh air inlet 50 in FIG. 1, for example, the third valve 52 may be provided at the connection portion with the crankcase 12 or may be provided at the connection portion with the intake manifold 26.

A control device 70 is configured by, for example, an engine control unit (ECU) which controls the operation of the entire engine 10, and includes a processor including a central processing unit (CPU) and a storage unit such as a read only memory (ROM) storing programs and the like, a random access memory (RAM) as a work area, and a flash memory. The control device 70 includes the valve control unit 72 which controls the opening degree of the third valve 52.

In this embodiment, the engine 10 is provided with the blow-by gas leak diagnostic device 100 for diagnosing whether or not a leak has occurred in the first PCV flow path 30 or the like. The blow-by gas leak diagnostic device 100 includes a pressure measurement unit 60 and a leak diagnosis unit 74 configuring the control device 70 in addition to the first PCV flow path 30, the second PCV flow path 40, the fresh air inlet 50, the first valve 32, the second valve 42, the third valve 52, and the valve control unit 72 which are described above.

The pressure measurement unit 60 is attached to, for example, the crankcase 12 and measures the inner pressure of the crankcase 12. In this embodiment, the crankcase 12 and the first PCV flow path 30 communicate with each other, and thus the inner pressure state of the first PCV flow path 30 also can be diagnosed at the same time by measuring the inner pressure of the crankcase 12. The pressure measurement unit 60 is connected to the control device 70 and outputs a detection signal corresponding to the measured inner pressure of the crankcase 12 to the leak diagnosis unit 74 of the control device 70.

The valve control unit 72 controls the opening degree of the third valve 52 in a case where the downstream side of the intake manifold 26 with respect to the throttle valve 24 has a negative pressure, and the second valve 42 is in a closed state. The function of the valve control unit 72 is realized by the processor or the like described above.

The leak diagnosis unit 74 determines whether or not a leak has occurred in the first PCV flow path 30 on the basis of the inner pressure information of the crankcase 12 output from the pressure measurement unit 60. Specifically, the leak diagnosis unit 74 diagnoses whether or not a leak has occurred in the first PCV flow path 30 on the basis of a comparison result between the inner pressure (for example, a differential pressure) of the crankcase 12, which is acquired from the pressure measurement unit 60, at the time of opening and closing the third valve 52 and a preset threshold. The function of the leak diagnosis unit 74 is realized by the processor or the like described above.

FIG. 2 is a table for explaining a relationship among the state of the engine 10, the state of the pressure of the intake manifold 26, the state of the first valve 32, the state of the second valve 42, and the state of the third valve 52 during operations at the time of low load, high load, and leak diagnosis. Incidentally, in this embodiment, a state where the engine 10 has a low load is, for example, the state of the engine 10 when the supercharger 22 is not operating. A state where the engine 10 has a high load is, for example, the state of the engine 10 when the supercharger 22 is operating.

When the state of the engine 10 is a low load as illustrated in (A) of FIG. 2, the downstream side of the intake manifold 26 with respect to the throttle valve 24 has a negative pressure and has a lower pressure than the upstream side of the intake manifold 26 with respect to the supercharger 22. In this case, the third valve 52 is controlled to be open so that a fresh air is introduced from the upstream side of the intake manifold 26 with respect to the supercharger 22 through the fresh air inlet 50 into the crankcase 12 to ventilate the inside of the crankcase 12.

At the same time, the first valve 32 becomes in an open state due to a pressure difference between the downstream side of the intake manifold 26 with respect to the throttle valve 24 and the inside of the crankcase 12. Accordingly, the blow-by gas in the crankcase 12 is introduced (suctioned) through the first PCV flow path 30 to the downstream side of the intake manifold 26 with respect to the throttle valve 24, and is returned to the combustion chamber 19.

On the other hand, the pressure of the upstream side of the intake manifold 26 with respect to the supercharger 22 is higher than the pressure of the downstream side of the intake manifold 26 with respect to the throttle valve 24, so that the second valve 42 becomes in the closed state, and the blow-by gas is prevented from flowing from the inside of the crankcase 12 to the intake manifold 26 through the second PCV flow path 40.

When the state of the engine 10 is a high load as illustrated in (B) of FIG. 2, the downstream side of the intake manifold 26 with respect to the throttle valve 24 has a positive pressure (an atmospheric pressure or higher) and has a higher pressure than the upstream side of the intake manifold 26 with respect to the supercharger 22. Therefore, the second valve 42 becomes in the open state, and the blow-by gas in the crankcase 12 is introduced through the second PCV flow path 40 to the downstream side of the intake manifold 26 with respect to the throttle valve 24.

On the other hand, the first valve 32 becomes in the closed state, and the blow-by gas is prevented from flowing from the crankcase 12 through the first PCV flow path 30 to the downstream side of the intake manifold 26 with respect to the throttle valve 24. Further, the third valve 52 is controlled to be closed, and the flow of blow-by gas from the inside of the crankcase 12 to the fresh air inlet 50 is blocked by the third valve 52.

The leak diagnosis of the first PCV flow path 30 illustrated in (C) of FIG. 2 can be executed, for example, at a predetermined timing during the time of low load when the engine 10 is driven by natural intake. When the state of the engine 10 is a low load, the third valve 52 is controlled to open, and a fresh air is introduced from the intake manifold 26 on the upstream side from the supercharger 22 through the fresh air inlet 50 into the crankcase 12. The pressure measurement unit 60 measures a first inner pressure P1 of the crankcase 12 when the third valve 52 becomes in the open state.

Next, the third valve 52 is controlled to be closed, and the introduction of a fresh air from the upstream side the intake manifold 26 with respect to the supercharger 22 through the fresh air inlet 50 into the crankcase 12 is blocked. At this time, the inner pressure of the crankcase 12 becomes a negative pressure due to the influence of the negative pressure generated in the intake manifold 26. The pressure measurement unit 60 measures a second inner pressure P2 of the crankcase 12 when the third valve 52 becomes in the closed state.

Here, in a case where the third valve 52 becomes in the closed state, and no leak has occurred in the first PCV flow path 30, the negative pressure in the first PCV flow path 30 and the crankcase 12 gradually increases with the passage of time. On the other hand, in a case where a leak occurs in the first PCV flow path 30, an air flows from the leak point into the first PCV flow path 30, so that the negative pressure in the first PCV flow path 30 and the crankcase 12 does not increase even with the passage of time. Therefore, in a state where no leak occurs in the first PCV flow path 30, a differential pressure P3 between the first inner pressure P1 of the crankcase 12 in the open state of the third valve 52 and the second inner pressure P2 of the crankcase 12 in the closed state of the third valve 52 increases.

In this regard, in this embodiment, the differential pressure P3 between the first inner pressure P1 of the crankcase 12 in the open state of the third valve 52 and the second inner pressure P2 of the crankcase 12 in the closed state of the third valve 52 at the time the engine 10 has a low load is calculated, and when the calculated differential pressure P3 is larger than a preset threshold Pth, it is diagnosed that no leak occurs in the first PCV flow path 30. On the other hand, when the calculated differential pressure P3 is smaller than the threshold Pth, it is diagnosed that a leak occurs in the first PCV flow path 30.

Incidentally, as the threshold Pth, an arbitrary value can be set by using, as a reference, the first pressure P1, the second pressure P2, and the differential pressure P3 in a normal state where no leak occurs in the first PCV flow path 30, for example. The threshold Pth is stored in a storage unit (not illustrated) provided in the control device 70.

Figure 3:
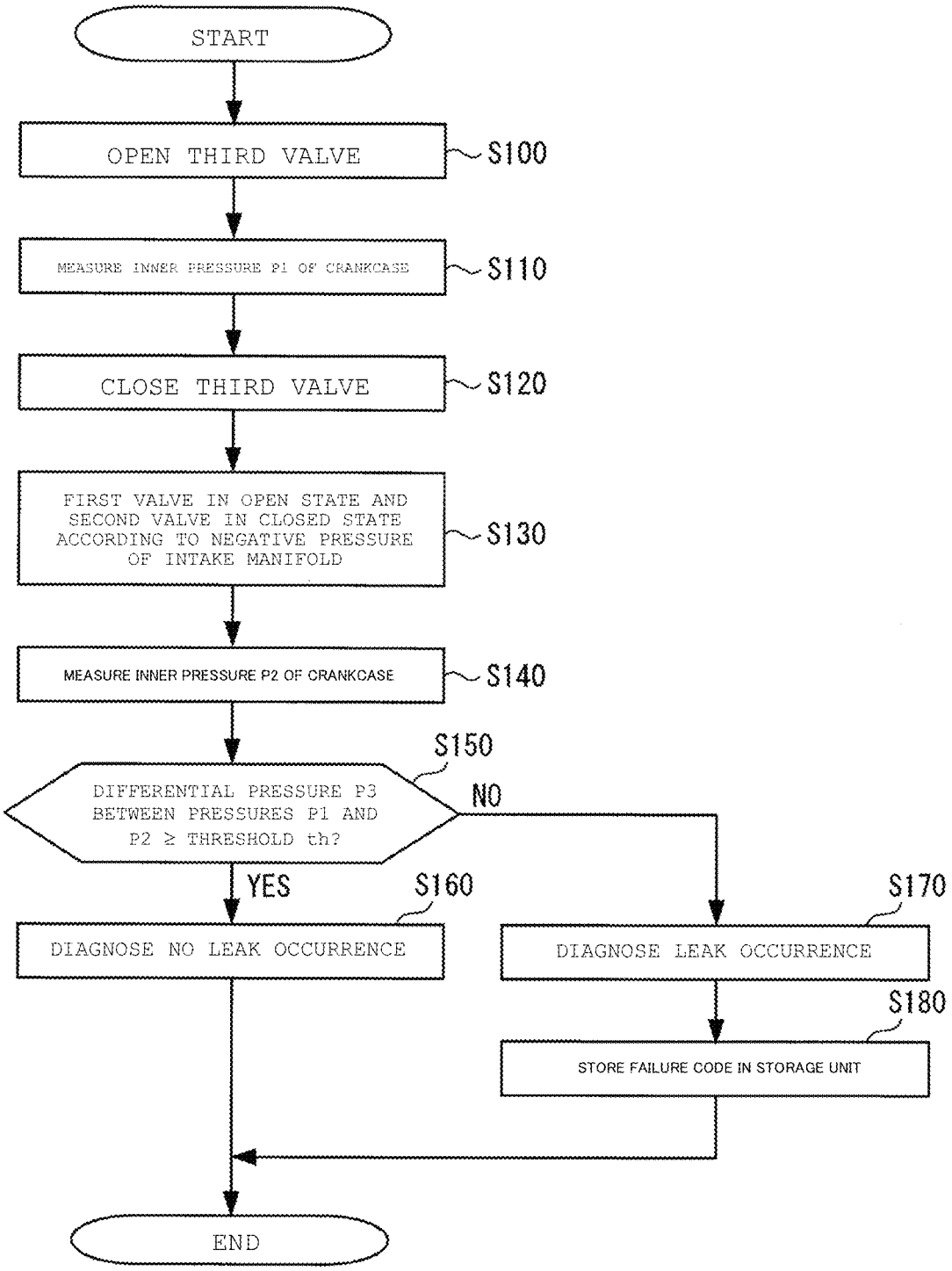
FIG. 3 is a flowchart at the time of leak diagnosis of a first PCV flow path by the blow-by gas leak diagnostic device.

Next, the operation at the time of leak diagnosis of the first PCV flow path 30 by the blow-by gas leak diagnostic device 100 will be described. FIG. 3 illustrates a flowchart at the time of leak diagnosis of the first PCV flow path 30 by the blow-by gas leak diagnostic device 100.

In step S100, the valve control unit 72 controls the third valve 52 provided in the fresh air inlet 50 to be open at a predetermined timing when the engine 10 is driven with a low load. Accordingly, the third valve 52 becomes in the open state, and a fresh air is introduced into the crankcase 12 from the upstream side of the intake manifold 26 with respect to the supercharger 22.

In step S110, the pressure measurement unit 60 measures the first inner pressure P1 of the crankcase 12 at the time the third valve 52 of the fresh air inlet 50 is in the open state, and outputs the detection signal indicating the measured first inner pressure P1 of the crankcase 12 to the leak diagnosis unit 74.

In step S120, the valve control unit 72 controls the third valve 52 provided in the fresh air inlet 50 to be closed. Accordingly, the third valve 52 becomes in the closed state, and the introduction of a fresh air from the upstream side of the intake manifold 26 with respect to the supercharger 22 into the crankcase 12 is blocked.

In step S130, when the engine 10 is driven with a low load, a negative pressure is generated in the downstream side of the intake manifold 26 with respect to the throttle valve 24. Accordingly, the first valve 32 becomes in the open state, and the second valve 42 becomes in the closed state.

In step S140, the pressure measurement unit 60 measures the second inner pressure P2 of the crankcase 12 at the time the third valve 52 of the fresh air inlet 50 is in the closed state, and outputs the detection signal indicating the measured second inner pressure P2 of the crankcase 12 to the leak diagnosis unit 74.

In step S150, the leak diagnosis unit 74 calculates the differential pressure P3 between the first inner pressure P1 of the crankcase 12 at the time the third valve 52 is in the open state and the second inner pressure P2 of the crankcase 12 at the time the third valve 52 is in the closed state on the basis of the detection signal supplied from the pressure measurement unit 60. Subsequently, it is diagnosed whether or not the calculated differential pressure P3 is equal to or more than the preset threshold Pth.

In a case where the differential pressure P3 in the crankcase 12 is equal to or more than the threshold Pth, the leak diagnosis unit 74 proceeds to step S160, diagnoses that no leak occurs in the first PCV flow path 30, and ends the leak diagnosis process.

On the other hand, in a case where the differential pressure P3 in the crankcase 12 is not equal to or more than the threshold Pth, that is, is less than the threshold Pth, the leak diagnosis unit 74 proceeds to step S170 and diagnoses a leak occurs in the first PCV flow path 30.

In step S180, the leak diagnosis unit 74 stores a failure code indicating that a leak occurs in the first PCV flow path 30 in a storage unit (not illustrated) in the control device 70, and ends the leak diagnosis process. Incidentally, as a means for notifying the occurrence of a leak in the first PCV flow path 30, for example, a display indicating the occurrence of a leak may be provided on the main panel of the driver's seat, or a voice guidance may be provided.

Incidentally, the second PCV flow path 40 communicates with the crankcase 12, and thus the leak diagnosis of the flow path including the second PCV flow path 40 can be performed by executing the method of diagnosing a leak in the first PCV flow path 30 as described above.

The method for diagnosing a leak in the first PCV flow path 30 as described above is not limited to the diagnostic method illustrated in FIG. 3. For example, when the engine 10 is driven with a low load, the inner pressure of the crankcase 12 is measured by the pressure measurement unit 60 after a lapse of a predetermined time after closing the third valve 52, and in a case where the inner pressure of the crankcase 12 is not equal to or less than the predetermined threshold (negative pressure value) due to air flowing into the first PCV flow path 30 or the like, it may be diagnosed that a leak occurs in the first PCV flow path 30.

According to this embodiment, when the engine 10 is driven with a high load, the blow-by gas in the crankcase 12 flows into the second PCV flow path 40 instead of the fresh air inlet 50. Thus, it is possible to prevent a deposit containing the blow-by gas from remaining in the third valve 52 in the fresh air inlet 50. Accordingly, the deterioration of the third valve 52 can be avoided. In particular, in a case where a rubber seal is used for the valve seat configuring the third valve 52, it is possible to effectively avoid the deterioration of the seal portion due to remaining deposits and to prevent the deterioration of the function of the third valve 52 deteriorates. As a result, when the leak diagnosis of the first PCV flow path 30 is performed, the function of the third valve 52 does not deteriorate, so that the leak diagnosis can be executed accurately and the accuracy of the leak diagnosis can be improved.

According to this embodiment, the third valve 52 provided in the fresh air inlet 50 is configured by an electromagnetic valve, and thus it is possible to improve the responsiveness at the time of opening and closing the third valve 52. Accordingly, it is possible to improve the accuracy of the leak diagnosis of the first PCV flow path 30.

Although the preferred embodiments of the present disclosure have been described in detail with reference to the accompanying drawings, the technical scope of the present disclosure is not limited to such examples. The configurations (constituent elements) described in the above-described embodiment may be combined in a rage without departing from the gist of the present invention, and addition, omission, substitution, and other modifications to the configurations are possible.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blow-by gas leak diagnostic device which include a first PCV flow path that allows a crankcase of an engine to communicate with a downstream side of an intake manifold of the engine with respect to a throttle valve, a second PCV flow path that allows the crankcase of the engine to communicate with an upstream side of the intake manifold with respect to the throttle valve, and a fresh air inlet that allows the crankcase of the engine to communicate with the upstream side of the intake manifold with respect to the throttle valve, and diagnoses a leak in the first PCV flow path, the blow-by gas leak diagnostic device comprising:

a pressure measurement unit that measures an inner pressure of the first PCV flow path;

a first valve that opens and closes the first PCV flow path;

a second valve that opens and closes the second PCV flow path;

a third valve that opens and closes the fresh air inlet;

a valve control unit that controls an opening degree of the third valve; and a leak diagnosis unit that diagnoses the leak in the first PCV flow path, wherein the valve control unit controls the opening degree of the third valve when the downstream side of the intake manifold with respect to the throttle valve has a negative pressure, and the second valve is in a closed state, and the leak diagnosis unit diagnoses presence or absence of the leak in the first PCV flow path on a basis of the pressure measured by the pressure measurement unit.

2. The blow-by gas leak diagnostic device according to claim 1, wherein the first valve and the second valve are one-way discharge valves, and the third valve is an electromagnetic valve.

3. The blow-by gas leak diagnostic device according to claim 1, wherein the leak diagnosis unit measures a first inner pressure of the engine when the third valve is in an open state and measures a second inner pressure of the engine when the third valve is in a closed state, and calculates a differential pressure between the first inner pressure and the second inner pressure after each measurement and diagnoses that a leak occurs in the first PCV flow path in a case where the differential pressure is not equal to or more than a threshold.

* * * * *